US005250991A

United States Patent [19]

Ikeda

[11] Patent Number: 5,250,991

[45] Date of Patent: Oct. 5, 1993

[54] IMAGE FORMING APPARATUS INCLUDING CLEANING MEANS FOR CLEANING CHARGING MEANS

[75] Inventor: Masamichi Ikeda, Yokohama, Japan

[73] Assignee: Canon Kabushiki Kaisha, Tokyo, Japan

[21] Appl. No.: 886,155

[22] Filed: May 21, 1992

[30] Foreign Application Priority Data

May 24, 1991 [JP] Japan ..... 3-148071

[51] Int. Cl.[5] ..... G03G 21/00

[52] U.S. Cl. ..... 355/215; 355/219

[58] Field of Search ..... 355/215, 219, 221; 250/324, 325, 326

[56] References Cited

U.S. PATENT DOCUMENTS

| | | | |
|---|---|---|---|
| 3,842,273 | 10/1974 | Van Buskirk | 250/324 |
| 3,870,833 | 3/1975 | Kinoshita | 179/115.5 VC |
| 3,965,499 | 6/1976 | Dunning, III | 5/13 |
| 4,788,573 | 11/1988 | Nakaoka et al. | 355/215 |
| 4,811,050 | 3/1989 | Tanjo et al. | 355/221 |
| 4,864,363 | 9/1989 | Shinada | 355/221 X |
| 4,885,466 | 12/1989 | Koichi et al. | 355/215 X |
| 4,924,268 | 5/1990 | Ogura | 355/219 |

FOREIGN PATENT DOCUMENTS

| | | |
|---|---|---|
| 54-28633 | 3/1979 | Japan . |
| 62-288865 | 12/1987 | Japan . |

*Primary Examiner*—Fred L. Braun

*Attorney, Agent, or Firm*—Fitzpatrick, Cella, Harper & Scinto

[57] ABSTRACT

In an image forming apparatus, while an engaging pawl of a driving unit for driving a cleaner for cleaning a charger performs one reciprocating movement along the charger, an engaging projection of the cleaner engages the engaging pawl. Hence, when the charger is remounted after first detaching it from the image forming apparatus, engagement between the cleaner and the driving unit can be securely performed. As a result, cleaning of the charger can be securely performed after mounting the charger on the image forming apparatus.

14 Claims, 8 Drawing Sheets

B

IMAGE FORMING APPARATUS INCLUDING CLEANING MEANS FOR CLEANING CHARGING MEANS

BACKGROUND OF THE INVENTION

1. Field of the Invention

This invention relates to an image forming apparatus, such as an electrophotographic copier, an electrophotographic printer or the like, and more particularly, to an image forming apparatus including a device for cleaning a charging means thereof.

2. Description of the Related Art

In an electrophotographic image forming apparatus, toner, dust or other contaminant particles are often airborne inside the apparatus. When copying operations are repeated for a long time period, these contaminant particles adhere to the shielding electrodes, and the corona wire (charging wire) electrodes of a corona charger incorporated in the apparatus. The contaminant particles accumulate in the respective units of the charger in accordance with an increasing number of copying operations. After about a few thousand copying operations, a decrease in charging efficiency, and uneven charging and charge-removing begin to occur due to the above-described adhering of contaminant particles. Consequently, the quality of copied images decreases.

In a conventional approach to overcome the above-described problems, for example, the user or serviceman of the copier periodically takes out the charger from within the apparatus to clean the charger, or cleans the charger accommodated within the apparatus by inserting a cleaning tool into the apparatus. However, a corona wire is in general a conductive thin wire made of tungsten or the like, and is apt to be cut by even a slight error in the cleaning operation. In addition, it is difficult to prevent a decrease in picture quality because the user may forget to periodically clean the wires. Further, it is necessary to clean contamination inside the charger after taking out the charger and visually confirming the contamination, and such an operation is very troublesome. Actually, the user often notices contamination inside the charger only after finding a decrease in the quality of copied images, and thereafter cleans the charger. Hence, it is difficult to always maintain the charger in a satisfactory state.

In order to overcome such problems, there have been proposals in which a charger is provided with a corona wire cleaning member movable along the corona wires, and a driving mechanism for moving the cleaning member. The corona wires are automatically cleaned by appropriately operating the driving mechanism in accordance with a program preset in a control circuit without taking out the charger from within the main body of the apparatus. Alternatively, a cleaning operation is occasionally performed by inputting an operational signal to the driving mechanism using a manual switch whenever necessary (see, for example, U.S. Pat. Nos. 3,842,273, 3,870,833 and 3,965,499, and Japanese Patent Application Public Disclosures (Kokai) Nos. 54-28633 (1979) and 62-288865 (1987).).

Since the charger is a consumable unit, it is provided as a service unit detachable from the apparatus. In an automatic cleaning means of a conventional charger, it is considered to be advantageous from a viewpoint of cost to provide only the cleaning means in the charger, and to provide a driving means in the main body of the apparatus.

Accordingly, it is necessary to have a configuration in which the cleaning means engages the driving means in order to form a transmission channel to transmit the driving force of the driving means to the cleaning means. Also it is necessary to have the cleaning means re-engage the driving means when the charger is mounted on the apparatus after first detaching the charger from the apparatus.

In a conventional configuration, the driving means engages the cleaning means by utilizing a difference between the upward and downward movements of the charger produced when the charger is in an operational state and in a non-operational state.

Such a configuration can be applied to a charger having upward and downward movements used, for example, in transfer and separation, but cannot be applied to a fixed charger used, for example, as a primary charger, or a post charger provided between development and transfer operations.

In addition, if the engagement between the cleaning means and the driving means is not securely performed, only the driving means freely reciprocates while the cleaning means does not move. Hence, the charging wires are not cleaned at all.

SUMMARY OF THE INVENTION

It is an object of the present invention to provide an image forming apparatus which can securely transmit the driving force of the above-described driving means to the cleaning means.

It is another object of the present invention to provide an image forming apparatus which prevents uneven charging by cleaning the charging means.

The present invention pertains to, in one aspect, an image forming apparatus comprising charging means for charging a member to be charged, cleaning means movable along the charging means for cleaning the charging means, and driving means movable along the charging means for transmitting to the cleaning means a driving force for moving the cleaning means along the charging means. The driving means is separable from the cleaning means, and the driving force of the driving means is transmitted to the cleaning means by a movement of the driving means along the charging means upon re-engagement of the driving means with the cleaning means after separation of the driving means from the cleaning means.

The foregoing and other objects, advantages and features of the present invention will become more apparent from the following detailed description of the preferred embodiments taken in connection with the accompanying drawings.

DETAILED DESCRIPTION OF THE PREFERRED EMBODIMENTS

Embodiments of the present invention will now be explained with reference to the drawings.

First, an outline of the entirety of an image forming apparatus will be explained with reference to FIG. 4.

Outline of the Entire Image Forming Apparatus

Figure 4:
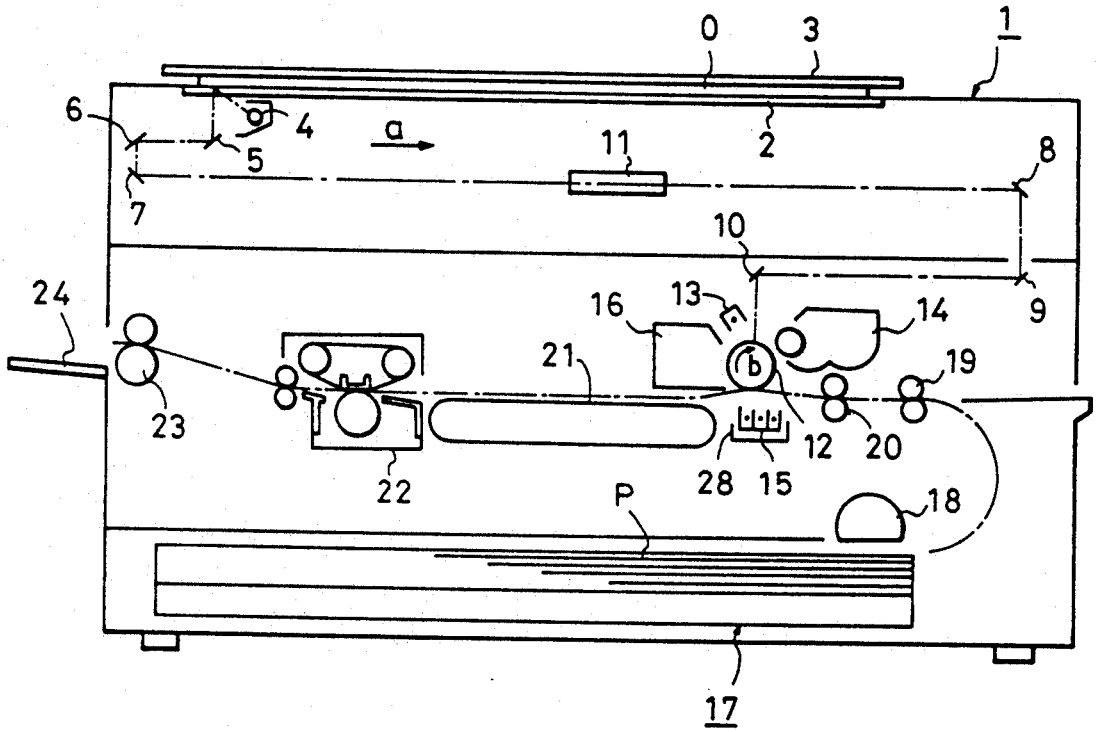
FIG. 4 is a schematic cross-sectional view illustrating the entirety of an image forming apparatus.

In FIG. 4, an original mount 2 comprising a transparent glass plate or the like is provided on the upper surface of a main body 1 of the apparatus. An original O to be copied is mounted on the original mount 2 with its image surface in a face-down state, and is held by being pressed by an original pressing plate 3.

An optical system comprising a light source 4, reflecting mirrors 5, 6, 7, 8, 9 and 10, an imaging lens 11, and the like is provided within the main body 1 of the apparatus. The original O on the original mount 2 is irradiated by light from the light source 4. Light reflected by the original O is guided to a photosensitive drum 12, serving as an image forming means, via the reflecting mirrors 5 through 10 and the imaging lens 11.

In an image forming operation, the light source 4 and the reflecting mirror 5 move in the direction of arrow "a" shown in FIG. 4 at a predetermined speed to scan the image surface of the original O.

A charger 13, a developing unit 14, a transfer/separation charger 15, and a cleaner 16 are arranged around the photosensitive drum 12. In an image forming operation, when the photosensitive drum 12 rotates in the direction of arrow "b" shown in FIG. 4 at a predetermined circumferential speed, the surface of the photosensitive drum 12 is uniformly charged by the charger 13. Subsequently, an electrostatic latent image corresponding to the image surface of the original O is formed by the optical system, and is developed by the developing unit 14 to form a developed image, i.e., a toner image.

A cassette 17 accomodating transfer sheets P is detachably mounted at a lower portion of the main body 1 of the apparatus. The transfer sheets P in the cassette 17 are individually separated by a pickup roller 18, and each of the separated sheets P is conveyed by conveying rollers 19 and enters a nip portion of registration rollers 20. The registration rollers 20 provide a feed timing so that the toner image on the photosensitive drum 12 coincides with the transfer sheet P, and feeds the transfer sheet P entered at the nip portion to a space between the photosensitive drum 12 and the transfer/separation charger 15.

Figure 1:
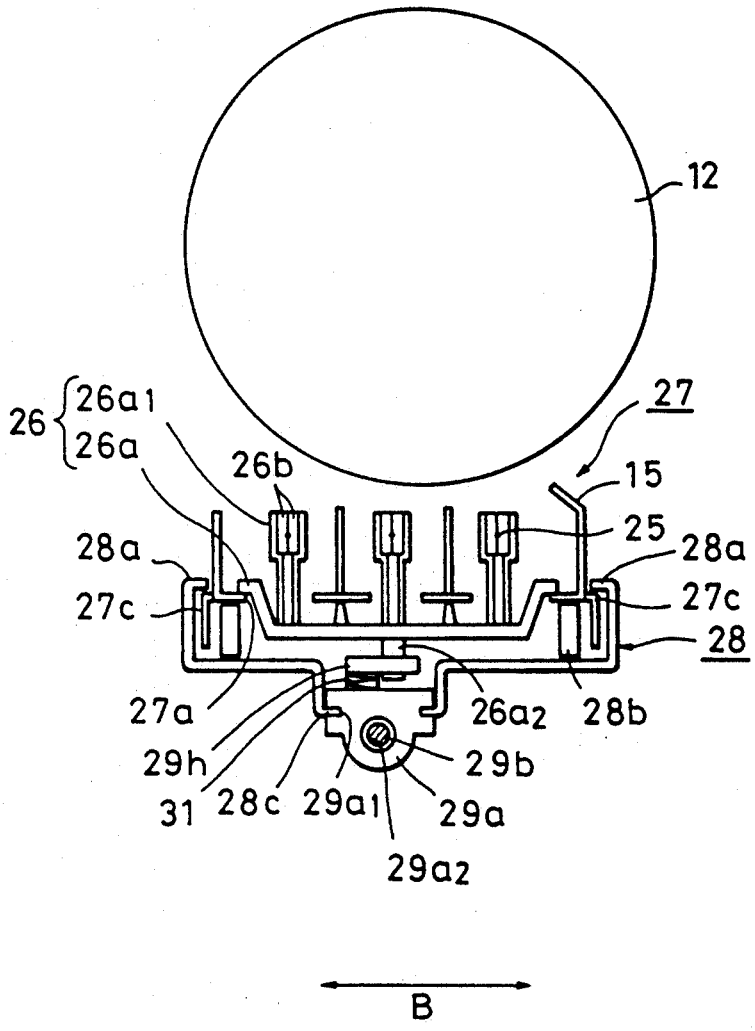
FIG. 1 is a cross-sectional view of a charger, a cleaning means, and a driving means thereof.

A charging element provided at the right end of the transfer/separation charger 15 shown in FIG. 1 transfers the toner image on the photosensitive drum 12 onto the fed transfer sheet P. After transfer charges have been removed and the transfer sheet P has been separated by two charging elements provided at the left side of the transfer/separation charger 15 shown in FIG. 1, the transfer sheet P to which the toner image has been transferred is conveyed to a fixing unit 22 by a conveying unit 21. After the toner image has been fixed by the fixing unit 22, the transfer sheet P is discharged onto a tray 24 provided outside the main body 1 of the apparatus by discharging rollers 23.

After the toner image has been transferred onto the transfer sheet P, toner particles remaining on the photosensitive drum 12 are removed, and the above-described image forming process is repeated.

Transfer/Separation Charger 15

The transfer/separation charger 15 will now be explained in detail with reference to FIGS. 1 through 3.

As shown in FIG. 1, the transfer/separation charger 15 provides charging wires 25, serving as wire electrodes, made of tungsten wire or the like inside a shielding member 27. A cleaning means 26 for cleaning the charging wires 25 is provided inside the shielding member 27 so as to be movable in the direction perpendicular to the plane of FIG. 1.

Cleaning Means

The cleaning means 26 provides cleaners 26*b* made of an elastic material, such as felt, sponge or the like, on a holder 26*a*, and moves in the axial direction of the charging wires 25 while holding them with the cleaners 26*b* to remove toner, dust and other contaminant particles accumulated on the charging wires 25.

The holder 26*a* is made of a flexible material, such as a synthetic resin or the like, and provides six ribs $26a_1$, to which the cleaners 26*b* are fixed using an adhesive or the like. An engaging projection $26a_2$ is provided at a lower portion of the holder 26*a*.

The cleaning means 26 configured as described above is set from an opening at one end (an end portion at the left side in FIG. 2, and an end portion situated at the front side when the cleaning means 26 is taken out from the main body 1 of the apparatus) in the longitudinal direction of the shielding member 27 having a substantially U-like cross-section, and is movable in the longitudinal direction of a slit 27*a* extended in the longitudinal direction provided at the bottom of the shielding member 27. Side walls 27*b* are vertically provided at end portions of the shielding member 27.

The transfer/separation charger 15 and the cleaning means 26 are detachably mounted on a rail member 28 fixed to the conveying member 21 in the main body 1 of the apparatus.

That is, side walls 28*a* having a substantially reverse C-shaped cross section are provided at both side positions in the direction of the width (direction B shown in FIG. 1) of the rail member 28. Guide members 27*c* provided at both side positions of the shielding member 27 engage the side walls 28*a*, whereby the shielding member 27 is mounted within the rail member 28. Springs 28*b* for upwardly pressing the charging wires 25 in the direction of the photosensitive drum 12 by pressing the guide members 27*c* are provided at the portions of the side walls 28*a*.

Figure 2:
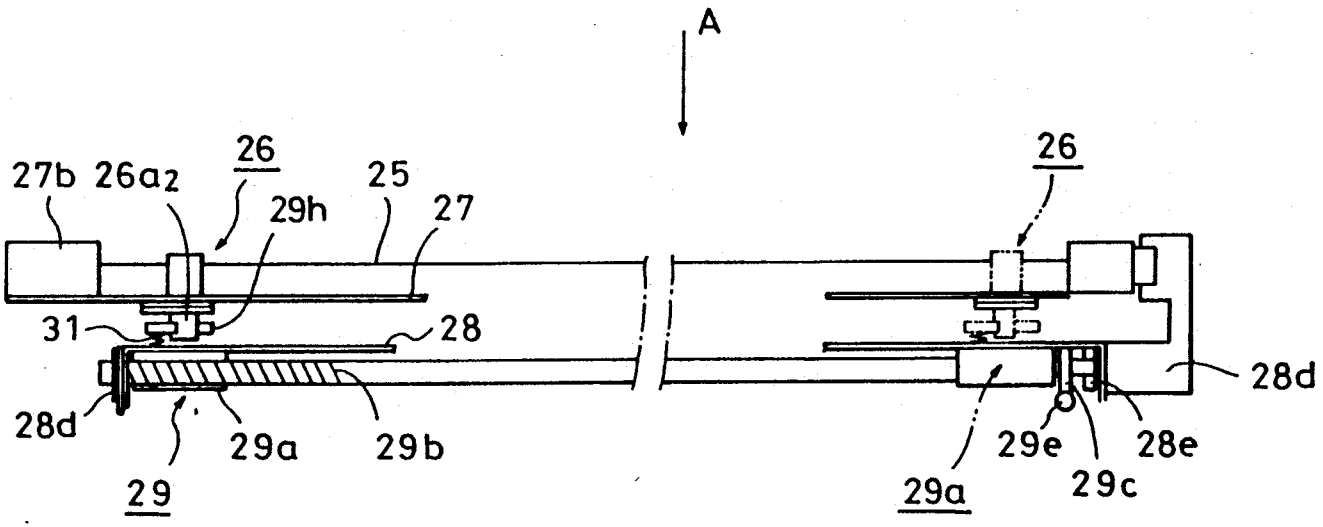
FIG. 2 is a side cross-sectional view of the charger, the cleaning means, and the driving means, partially omitting some components.
Figure 3:
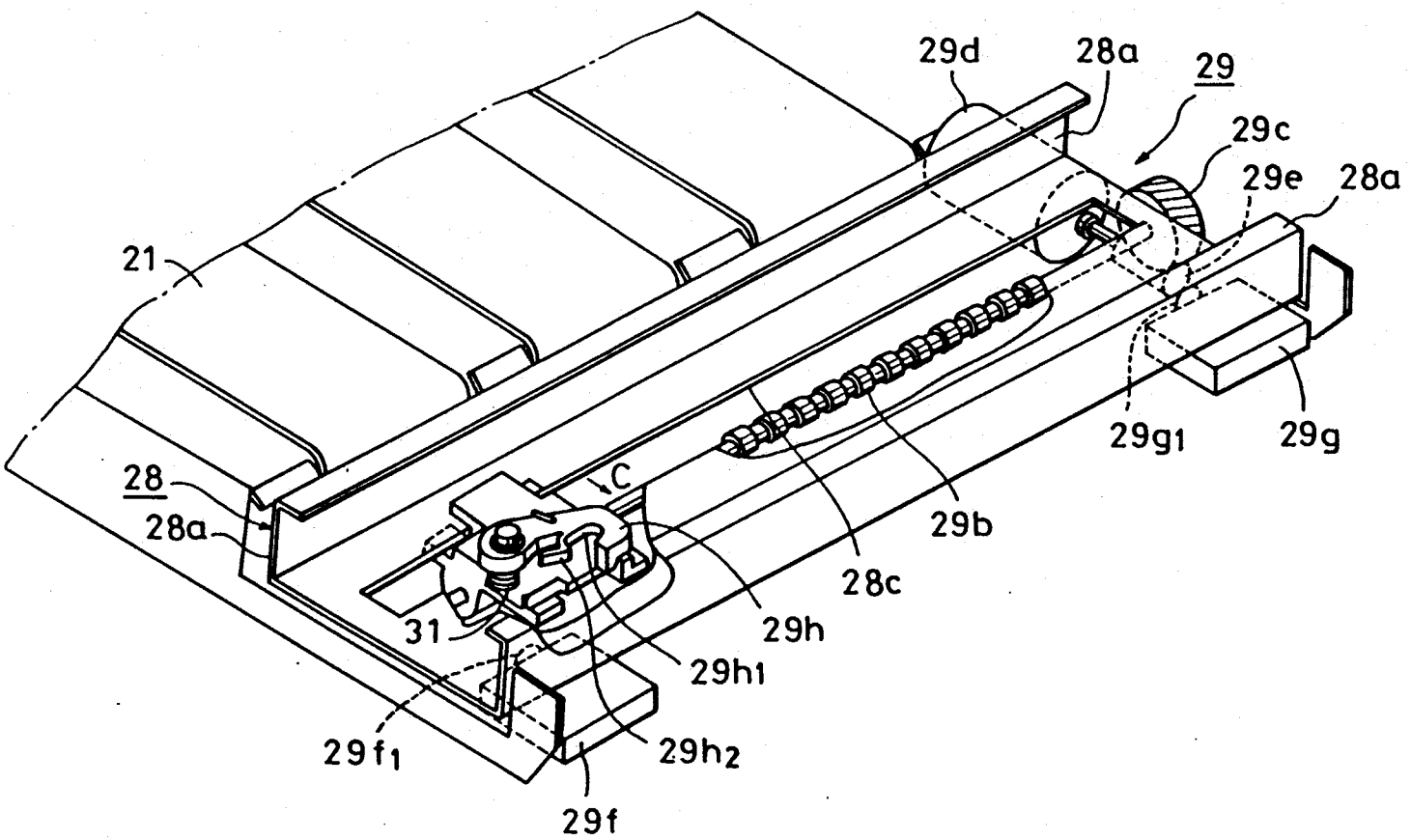
FIG. 3 is a perspective view illustrating the driving means.

As shown in FIGS. 2 and 3, a driving means 29 for the cleaning means 26 is mounted on the rail member 28.

That is, a slit 28*c* extended in the longitudinal direction is provided at a central position of the base of the rail member 28, and a driving block 29*a* forming part of the driving means 29 is movably mounted on the slit 28*c*.

Driving Means

Figure 6:
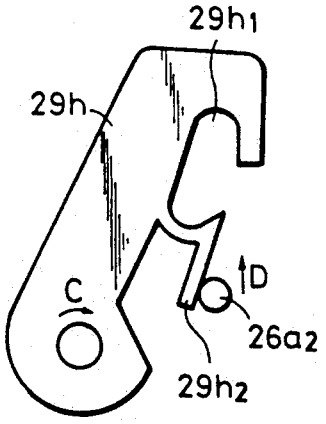
FIGS. 6(*a*), 6(*b*) and 6(*c*) are diagrams illustrating various states of engagement between an engaging projection and an engaging pawl.
Figure 6:
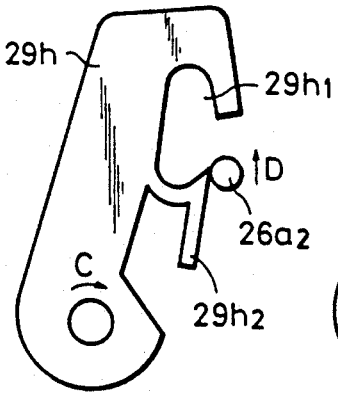
Figure 6:
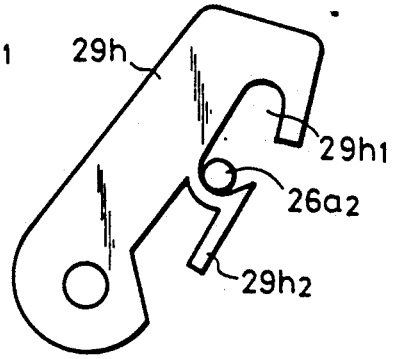

As shown in FIGS. 1 and 3, guide grooves $29a_1$ engaging inner edges of the slit 28*c* are formed at both sides of the driving block 29*a*. A tapped hole 29$a_2$ threaded in the axial direction is provided at a lower portion of the driving block 29*a*. A lead screw 29*b* disposed in a state parallel to the slit 28*c* at a lower portion of the rail member 28 meshes the tapped hole 29$a_2$. The driving block 29*a* moves along the slit 28*c* in the longitudinal direction of the charger by the rotation of the lead screw 29*b*. In addition, an engaging pawl 29*h* made of synthetic resin is provided at an upper portion of the driving block 29*a*. The engaging projection 26$a_2$ engages a notch portion of the engaging pawl 29*h*, whereby the cleaning member 26 is connected to the driving means 29. As shown in FIGS. 3 and 6, the engaging pawl 29*h* is biased in the direction of arrow c by a torsion coil spring 31.

As shown in FIGS. 2 and 3, the lead screw 29*b* has substantially the same length as the transfer/separation charger 15, and is rotatably supported by bearing members 28*d* provided at both end positions in the longitudinal direction of the rail member 28 via sliding bearings 28*e*. A worm gear wheel 29*c* is provided at one end portion (the right sides in FIGS. 2 and 3) in the axial direction of the lead screw 29*b*. A worm gear 29*e* rotatably driven by a driving motor 29*d* meshes the worm gear wheel 29*c*. Accordingly, by rotating the driving motor 29*d* in the forward and reverse directions, the driving block 29*a* reciprocates between one end (the front side) and the other end (the rear side) in the longitudinal direction of the slit 28*c*, whereby the cleaning means 26 reciprocates by being guided by the slit 27*a* within the shielding member 27 to clean the charging wires 25.

The driving motor 29*d* is fixed to the conveying member 21.

The conveying member 21 is mounted on the main body 1 of the apparatus so as to be swingable around a rear-end portion at the side of the fixing unit 22, and to be separable from the photosensitive drum 12 as one body with the rail member 28 and the transfer/separation charger 15, for example, for the purpose of freeing a jammed transfer sheet P. In an operational state, in order to maintain constant the gap between the charging wires 25 and the shielding member 27 of the transfer/separation charger 15 and the photosensitive drum 12 constant, the conveying member 21 is moved upwardly until part of the transfer/separation charger 15 (part of the shielding member 27) contacts a supporting member (not shown) of the photosensitive drum 12, and is locked on the main body 1 of the apparatus at the moved position. At that time, the shielding member 27 is pressed downwardly against the spring force of the upwardly-pressing spring 28*b* within the rail member 28 by the supporting member of the photosensitive drum 12 (see FIG. 1).

As shown in FIG. 3, microswitches 29*f* and 29*g*, serving as detection means, are provided near both end portions in the longitudinal direction of the lower surface of the rail member 28. The switch 29*f* is disposed at a left-end portion of the rail member 28, which position is set as a waiting position of the cleaning means 26 (the position where the charger performs a charging operation). The switch 29*g* is disposed at a right-end portion of the rail member 28.

Figure 5:
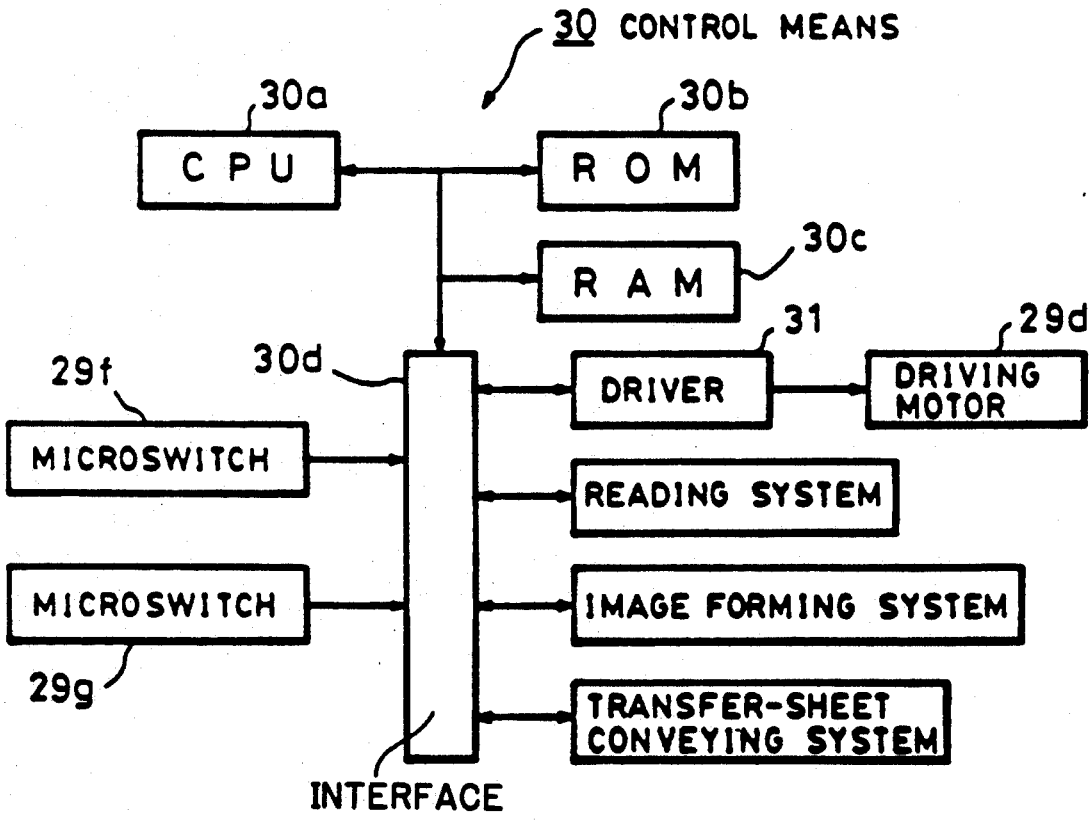
FIG. 5 is a block diagram of a control means of the entire image forming apparatus including the driving means.

The microswitches 29*f* and 29*g* detect that the driving block 29*a* has moved to an end portion of the moving range in the longitudinal direction of the rail member 28 when part of the driving block 29*a* pushes levers 29$f_1$ and 29$g_1$ of the microswitches 29*f* and 29*g*. A detection signal of the microswitch 29*f* is input to a control means 30 shown in FIG. 5.

CONTROL MEANS

Figure 7:
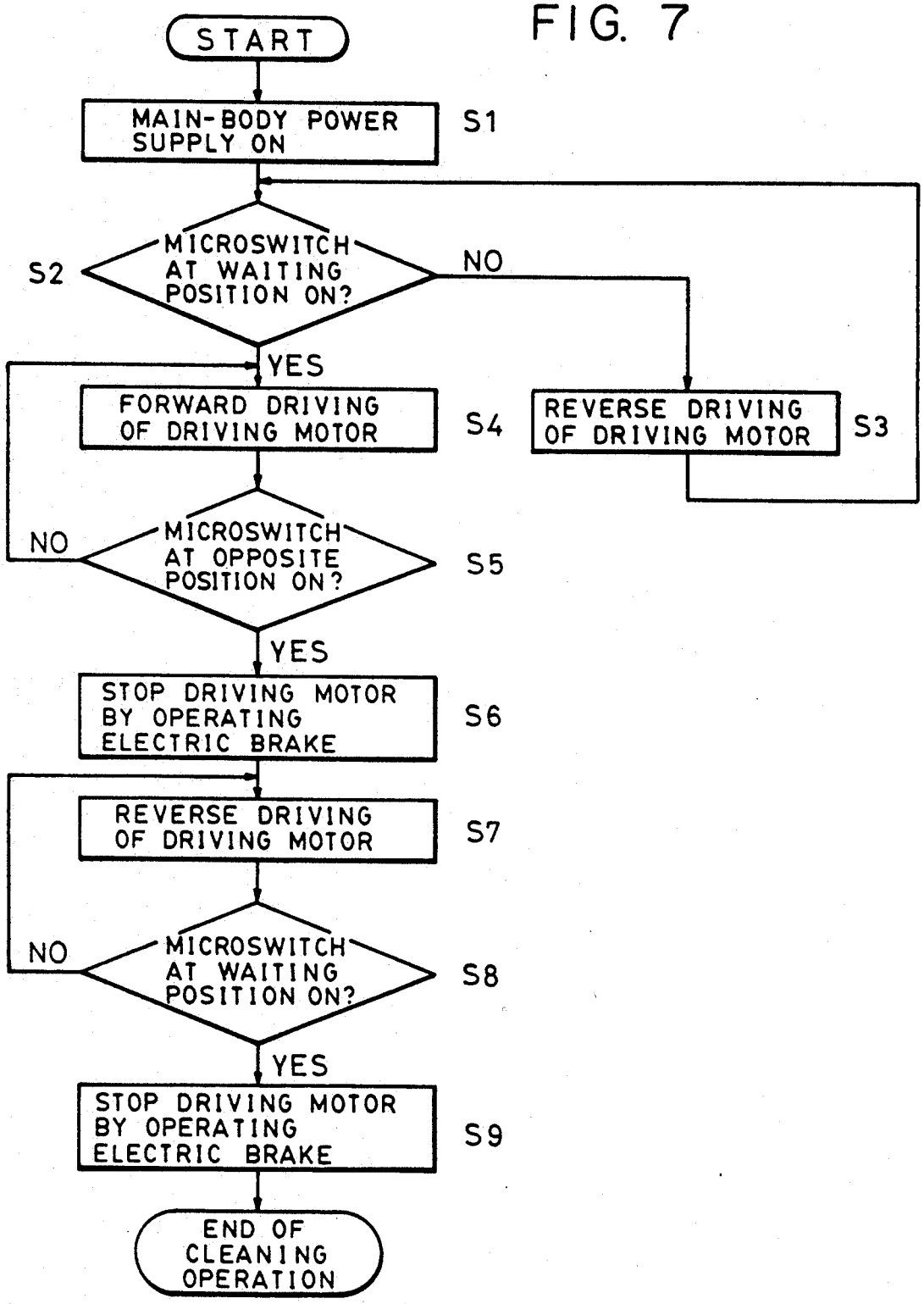
FIG. 7 is a flowchart showing the control of the driving means.

The control means controls the entire image forming apparatus including the driving means 29, and comprises a CPU 30*a* for controlling the entire apparatus, a ROM 30*b* storing information concerning the control of the driving means 29, as shown in FIG. 7, and the like, a RAM 30*c* used as a work storage area and for temporarily storing various kinds of data, an interface 30*d* and the like.

The microswitches 29*f* and 29*g* are connected to the input-port side of the interface 30*d*. The driving motor 29*d* is connected to the output-port side of the interface 30*d* via a driver 31. The reading system (the light source 4, the reflecting mirror 5 and the like), the image forming system (the photosensitive drum 12, the charger 13, the transfer/separation charger 15, and the like) and the transfer-sheet conveying system (the pickup roller 18, the conveying rollers 19, the conveying member 21, and the like) are also connected to the output-port side of the interface 30*d*.

Next, the operation of the above-described embodiment will be explained.

When the transfer/separation charger 15, detached from the main body 1 of the apparatus, is mounted again on the main body 1 of the apparatus, the conveying member 21 is separated from the photosensitive drum 12.

In this state, if the transfer/separation charger 15 is inserted into the rail member 28 by engaging the guide members 27*c* of the shielding member 27 of the transfer/separation charger 15 with the side walls 28*a* of the rail member 28, the guide members 27*c* are upwardly pressed toward the upper surfaces of the side walls 28*a* by the upwardly-pressing springs 28*b*, as shown in FIG. 1.

The driving block 29*a* usually stops near the microswitch 29*f* (one end in the longitudinal direction of the rail member 28). Hence, if the transfer/separation charger 15 is inserted toward the other end (the rear-end side) in the longitudinal direction of the rail member 28, the engaging pawl 29*h* is rotated in the direction reverse to arrow "C" against the biasing force of the torsion coil spring 31 by the movement of the engaging projection 26$a_2$ of the holder 26*a* in the direction of arrow D to engage the engaging projection 26$a_2$ with a notch 29$h_1$, as shown in FIGS. 6(*a*)–6(*c*).

Thus, the main body 1 of the apparatus assumes an operational state. In this state, the driving means 29 is controlled in accordance with the flowchart shown in FIG. 7.

First, when power has been supplied to the main body 1 of the apparatus in step S1, the process proceeds to step S2, where the CPU 30*a* determines whether the microswitch 29*f* at the waiting position is switched on. If the result of the determination is affirmative, that is, if the driving block 29*a* is situated at the waiting position of the rail member 28 (the lead screw 29*b*), the process proceeds to step S4, where the driving motor 29*d* rotates in the forward direction. If the result of the determination in step S2 is negative, the process proceeds to step S3, where the driving motor 29*d* rotates in the reverse direction to return the driving block 29*a* to the waiting position of the rail member 28.

When the driving motor 29*d* rotates in the forward direction in step S4, the rotation of the driving motor 29*d* is transmitted to the lead screw 29*b* via meshing between the worm gear 29*e* and the worm gear wheel 29*c* to rotate the lead screw 29*b*. The driving block 29*a* thereby moves from one end to the other end in the longitudinal direction of the rail member 28 by being guided by the slit 28*c*, whereby the holder 26*a* also moves in the same direction by being guided by the slit 27*a*. During such movement, toner, dust, and other contaminant particles, adhering to the charging wires 25, are removed by the cleaners 26*b*.

The process then proceeds to step S5, where the CPU 30*a* determines whether the microswitch 29*g* provided at a position opposite to the waiting position is switched on. If the result of the determination is negative, the process proceeds to step S4, where the forward rotation of the driving motor 29*d* is continued.

If the result of the determination in step S5 is affirmative, that is, if the driving block 29*a* has moved to the read-end side in the longitudinal direction of the transfer/separation charger 15 and pushed the lever $29g_1$ of the microswitch 29*g*, the process proceeds to step S6, where the driving motor 29*d* is stopped by operating an electric brake (not shown) provided within the driving circuit.

The process then proceeds to step S7, where the driving motor 29*d* is rotated in the reverse direction after the lapse of a predetermined time period. When the driving motor 29*d* is rotated in the reverse direction, the holder 26*a* is moved to the waiting-position side which is one end in the longitudinal direction of the rail member 28 by the driving block 29*a*. During such movement, toner, dust, and other contaminant particles adhering to the charging wires 25 are removed in the same manner as described above.

The process then proceeds to step S8, where the CPU 30*a* determines whether the microswitch 29*f* is switched on. If the result of the determination is negative, the process proceeds to step S7, where the reverse rotation of the driving motor 29*d* is continued.

If the result of the determination in step S8 is affirmative, that is, if the driving block 29*a* has moved to the waiting position which is a front-end portion in the longitudinal direction of the transfer/separation charger 15 and pushed the lever $29f_1$ of the microswitch 29*f*, the process proceeds to step S9, where the driving motor 29*d* is stopped by operating the electric brake in the driving circuit in the same manner as described above.

The driving block 29*a* is thereby stopped near the microswitch 29*f* (one end in the longitudinal direction of the rail member 28) to terminate cleaning of the charging wires 25.

As described above, when the driving block 29*a* has been detected at the one-end side in the longitudinal direction of the rail member 28 by the microswitches 29*f* and 29*g*, current supply to the driving motor 29*d* is immediately stopped. Hence, no torque will be applied to the lead screw 29*b* in a locked state, and the lead screw 29*b* will not be deformed.

In removing the transfer/separation charger 15 from the main body 1 of the apparatus for the purpose of maintenance or the like, if the conveying member 21 is separated from the photosensitive drum 12, the shielding member 27 is released from the holding member of the photosensitive drum 12.

As shown in FIGS. 6(*a*) through 6(*c*), the front side of the notch $29h_1$ of the engaging pawl 29*h* is made of a resinous material and has an elastic portion $29h_2$. Hence, the transfer/separation charger 15 can be detached by bending the elastic portion $29h_2$ of the engaging pawl 29*h* by the engaging projection $26a_2$ provided at a lower portion of the holder 26*a*. In this way, the transfer-separation charger 15 can be detached from the apparatus by separating the cleaning means, from the driving means for transmitting the driving force to the cleaning means.

In the above-described embodiment, in cleaning the transfer/separation charger 15, the cleaning means 26 reciprocates after first returning to the waiting position no matter where the cleaning means 26 stops. Hence, a secure cleaning operation can be performed.

Furthermore, since the microswitches 29*f* and 29*g* detect the cleaning means 26 when it has moved to an end portion of the moving range and stop driving of the driving motor 29*d*, an impulsive external force will not be applied by the stop-page of the driving motor 29*d*, and the lead screw 29*b* will not be deformed.

Furthermore, the cleaning means 26 and the driving means 29 can be easily detached by merely engaging or disengaging the engaging projection $26a_2$ of the holder 26*a* relative to the engaging pawl 29*h*. Hence, it is possible to efficiently perform maintenance or the like of the transfer/separation charger 15. When the charger has been mounted on the apparatus, the cleaning means re-engage the driving means.

When the driving means is not first situated at a predetermined end position as, for example, when the power supply of the apparatus is turned off during a cleaning operation of the charger, the engaging projection $26a_2$ can securely engage the engaging pawl 29*h* while the driving means performs one reciprocating movement as described above, even if the cleaning means 26 cannot engage the engaging pawl 29*h* when the charger is initially inserted into the main body of the apparatus.

Figure 8:
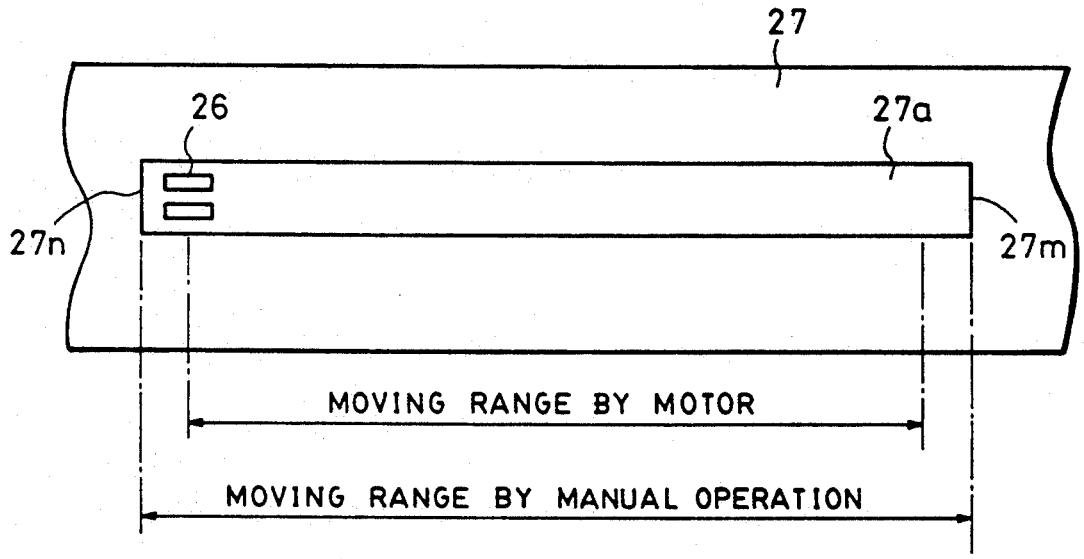
FIG. 8 is a schematic plan view, as seen from the direction of arrow "A" shown in FIG. 2.

Since the notch $29h_1$ of the engaging pawl 29*h* is larger than the engaging projection $26a_2$, the engaging projection $26a_2$ has some play within the notch $29h_1$. Hence, when the cleaning means 26 is moved by the driving motor 29 after being engaged, the range of movement is slightly smaller than the range of movement by a manual operation. Therefore, it is possible to prevent the cleaning member 26 from contacting end portions 27*m* and 27*n* of the slit 27*a* to provide excessive load to the driving motor 29*d*, as shown in FIG. 8.

It is, of course, possible to clean the charging wires 25 by manually operating the holder 26 after taking the transfer/separation charger 15 out of the main body 1 of the apparatus.

Although, in the above-described embodiment, an explanation has been provided of a case wherein the microswitches 29*f* and 29*g*, serving as the detection means of the cleaning means 26, are disposed at both ends of the moving range of the cleaning means 26, as an alternative, only the microswitch 29*f* may be disposed at the waiting position as the detection means. Also in this case, the same effects as in the above-described embodiment can be obtained if a cleaning operation is started after the microswitch 29*f* has detected that the cleaning means 26 has reached the waiting position.

It is, of course, possible to use optical sensors or the like as the detection means in place of the microswitches 29*f* and 29*g*.

Although, in the above-described embodiment, an explanation has been provided of a case wherein the driving block 29a is moved by the lead screw 29b, the driving block 29a may be reciprocated while being fixed to a belt. In this case, since a pulley and a belt are used in place of the lead screw 29b, the worm gear wheel 29c, and the worm gear 29e, the mechanism is simplified.

In the above-described embodiment, the transfer/-separation charger 15 is cleaned by the cleaning means 26. However, the same configuration may, of course, be adopted also when the primary charger 13 or the like is cleaned.

As explained above, according to the present invention, the driving force of the driving means can be transmitted to the cleaning means by moving the driving means. Hence, even if the charger is fixed, the charger can be securely cleaned, whereby a decrease in picture quality can be prevented.

While the present invention has been described with respect to what are presently considered to be the preferred embodiments, it is to be understood that the invention is not limited to the disclosed embodiments. The present invention is intended to cover various modifications and equivalent arrangements include within the spirit and scope of the appended claims.

What is claimed is:

1. An image forming apparatus, comprising:

a charging unit detachably mountable to said apparatus, said charging unit comprising charging means for charging a member to be charged, and cleaning means, movable along said charging means within a cleaning range, for cleaning said charging means; and driving means movable along said charging means for transmitting to said cleaning means a driving force for moving said cleaning means along said charging means, said driving means being separated from said cleaning means when said charging unit is detached from said apparatus, wherein the driving force of said driving means is transmitted to said cleaning means after re-engagement of said driving means with said cleaning means by movement of said driving means along said charging means when said charging unit is mounted to said apparatus, independent of a stopping position of said cleaning means within the cleaning range.

2. An image forming apparatus according to claim 1, wherein the driving force of said driving means is transmitted to said cleaning means by an engagement between said driving means and said cleaning means while said driving means moves along said charging means when said charging unit is mounted to said apparatus.

3. An image forming apparatus according to claim 2, wherein said cleaning means comprises a projection and said driving means comprises a notch for engagement with said projection.

4. An image forming apparatus according to claim 3, wherein said notch occupies a larger space than said projection in the moving direction.

5. An image forming apparatus according to claim 4, wherein said cleaning means is adapted to be manually moved during the separation of said driving means and said cleaning means.

6. An image forming apparatus according to claim 2, wherein said driving means is adapted to reciprocate along said charging means, and said driving means re-engages said cleaning means when said driving means performs one reciprocating movement along said charging means.

7. An image forming apparatus according to claim 1, wherein said cleaning means is adapted to be manually moved during the separation of said driving means and said cleaning means.

8. An image forming apparatus according to claim 7, wherein said cleaning means is movable along said charging means within a larger range when said cleaning means is moved by a manual operation than when said cleaning means is moved by said driving means.

9. An image forming apparatus according to claim 1, wherein said charging means comprises a corona charger including a wire electrode and a shielding electrode, and wherein said cleaning means moves alongside and cleans said wire electrode.

10. An image forming apparatus according to claim 9, wherein said driving means is adapted to reciprocate along said wire electrode, and said driving means re-engages said cleaning means when said driving means performs one reciprocating movement along said wire electrode.

11. An image forming apparatus according to claim 1, wherein said driving means is adapted to reciprocate along said charging means, and said driving means re-engages said cleaning means when said driving means performs one reciprocating movement along said charging means.

12. An image forming apparatus according to claim 1, further comprising image forming means for forming an image on a recording material, said image forming means including said charging means.

13. An image forming apparatus according to claim 12, wherein said member to be charged comprises an image bearing member.

14. An image forming apparatus according to claim 1, wherein said cleaning means comprises a projection, and said driving means comprises a pivotable member having a notch for engagement with said projection, and a biasing member for biasing said pivotable member, said projection engaging with said notch against a biasing force of said biasing member by movement of said cleaning means along said charging means when said charging unit is mounted to said apparatus.

* * * * *